US009297619B1

(12) United States Patent
Al-Qanaei

(10) Patent No.: US 9,297,619 B1
(45) Date of Patent: Mar. 29, 2016

(54) BULLET FOR STRIKING OBSTRUCTED TARGETS

(71) Applicant: Ahmad Abdullah M. J. Al-Qanaei, Salwa (KW)

(72) Inventor: Ahmad Abdullah M. J. Al-Qanaei, Salwa (KW)

( * ) Notice: Subject to any disclaimer, the term of this patent is extended or adjusted under 35 U.S.C. 154(b) by 0 days.

(21) Appl. No.: 14/789,974

(22) Filed: Jul. 1, 2015

(51) Int. Cl.

| | |
|---|---|
| ***F42B 5/10*** | (2006.01) |
| ***F42B 15/00*** | (2006.01) |
| ***F42B 12/62*** | (2006.01) |
| ***F42B 5/02*** | (2006.01) |
| ***F42B 12/02*** | (2006.01) |

(52) U.S. Cl.
CPC . *F42B 5/105* (2013.01); *F42B 5/10* (2013.01); *F42B 12/62* (2013.01); *F42B 5/02* (2013.01); *F42B 12/02* (2013.01); *F42B 15/00* (2013.01)

(58) Field of Classification Search
CPC ..... F42B 5/10; F42B 5/105; F42B 5/02; F42B 5/03; F42B 12/02; F42B 12/56; F42B 12/58; F42B 12/62
USPC ..... 102/443, 374, 376, 377, 380, 430, 438, 102/439, 501, 517, 519, 293
See application file for complete search history.

(56) References Cited

U.S. PATENT DOCUMENTS

| | | | | |
|---|---|---|---|---|
| 3,580,172 | A | 5/1971 | Hendricks | |
| 3,903,802 | A * | 9/1975 | Squiers | F42B 5/10 102/376 |
| 3,922,967 | A * | 12/1975 | Mertens | F42B 5/10 102/439 |
| 4,574,702 | A * | 3/1986 | Brandt | F42B 10/48 102/244 |
| 7,089,865 | B2 | 8/2006 | Regev | |
| 7,603,998 | B2 | 10/2009 | Finstad | |
| 8,640,622 | B2 * | 2/2014 | Eckstein | F42B 12/60 102/438 |
| 8,640,623 | B2 * | 2/2014 | Eckstein | F42B 5/03 102/438 |
| 2007/0125351 | A1 | 6/2007 | Campo et al. | |

* cited by examiner

*Primary Examiner* — James S Bergin
(74) *Attorney, Agent, or Firm* — Richard C. Litman

(57) ABSTRACT

The bullet for striking obstructed targets includes a main bullet casing having a primary front portion and a primary rear portion, the main bullet casing including a primary propellant and a primary firing means configured to ignite the primary propellant, the primary firing means positioned in the primary rear portion of the main bullet casing, a detachable bullet casing having a secondary front portion and a secondary rear portion, the detachable bullet casing positioned in communicating relation to the main bullet casing, the detachable bullet casing including a secondary propellant and a secondary firing means configured to ignite the secondary propellant, the secondary firing means positioned in the secondary front portion of the detachable bullet casing, and a bullet head positioned on the secondary front portion of the detachable bullet casing, the bullet head having a triggering means positioned in communicating relation to the secondary firing means configured to ignite the secondary firing means.

7 Claims, 7 Drawing Sheets

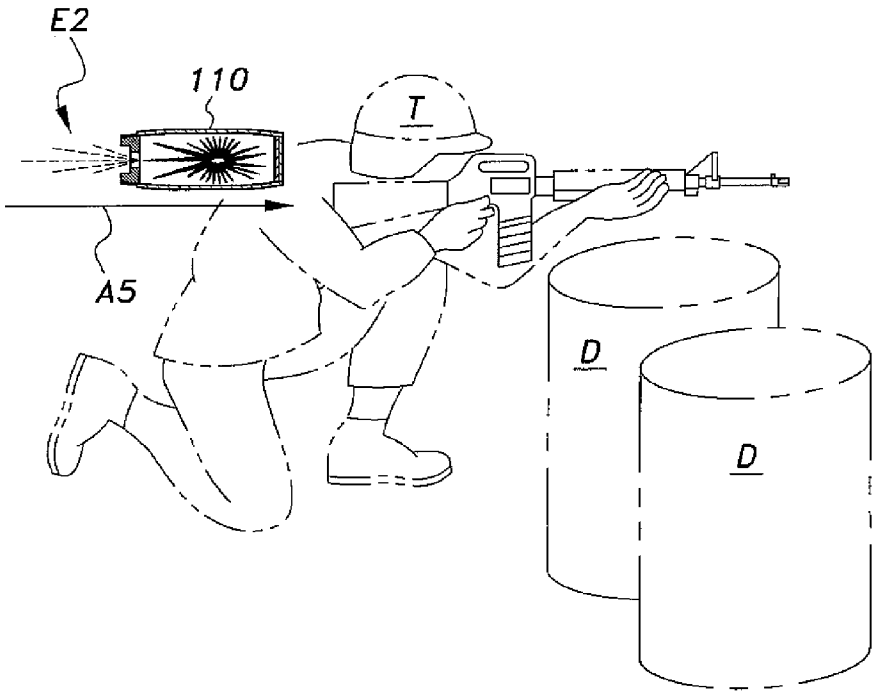
Fig. 3C
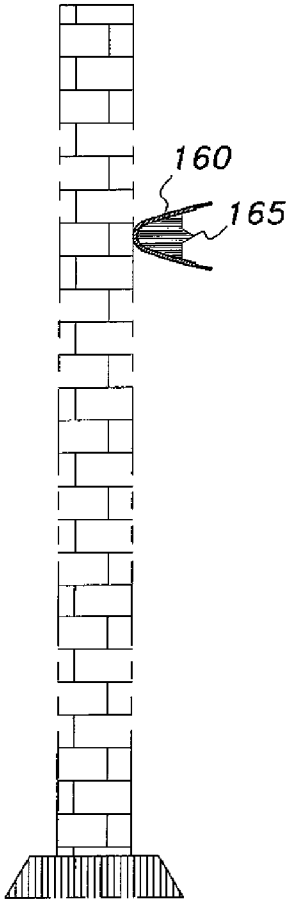

BULLET FOR STRIKING OBSTRUCTED TARGETS

BACKGROUND OF THE INVENTION

1. Field of the Invention

The present invention relates to ammunition, and particularly to a bullet for striking an obstructed target.

2. Description of the Related Art

Currently, there exist a wide variety of bullets, which include a bullet head, a casing made from either plastic, metal, or paper, and a primer that fits inside the casing, which is made to fit into the firing chamber of a light weapon. Since bullets do not contain explosives, they can typically only damage a target by impact and penetration. Therefore, regardless of the type of light weapon in which the bullet is being used, accuracy is required to damage the target. If the bullet misses the target, the target suffers no damage. Even when the bullet misses the target and hits an object proximate to the target, the target rarely suffers significant damage since the damage caused by a ricocheted bullet is typically small. As such, people who want to avoid a direct hit from a bullet will typically hide behind an obstruction that will not allow a bullet to pass.

Thus, a bullet for striking obstructed targets solving the aforementioned problems is desired.

SUMMARY OF THE INVENTION

An embodiment of a bullet for striking obstructed targets includes a main bullet casing having a primary front portion and a primary rear portion, the main bullet casing including a primary propellant and a primary firing means configured to ignite the primary propellant, the primary firing means positioned in the primary rear portion of the main bullet casing, a detachable bullet casing having a secondary front portion and a secondary rear portion, the secondary rear portion of the detachable bullet casing being positioned in communicating relation to the primary front portion of the main bullet casing, the detachable bullet casing including a secondary propellant and a secondary firing means configured to ignite the secondary propellant, the secondary firing means positioned in the secondary front portion of the detachable bullet casing, and a bullet head positioned on the secondary front portion of the detachable bullet casing, the bullet head having a triggering means being positioned in communicating relation to the secondary firing means configured to ignite the secondary firing means.

The bullet for striking obstructed targets can be used with any type of light weapon. Being originally fired from the weapon using the weapon's firing pin, the second cartridge will travel past an obstructed/hidden target until it strikes a stationary object.

These and other features of the present invention will become readily apparent upon further review of the following specification and drawings.

BRIEF DESCRIPTION OF THE DRAWINGS

FIG. 3C illustrates a detachable bullet casing striking an obstructed target according to the present invention.

Similar reference characters denote corresponding features consistently throughout the attached drawings.

DETAILED DESCRIPTION OF THE PREFERRED EMBODIMENTS

Figure 1A:
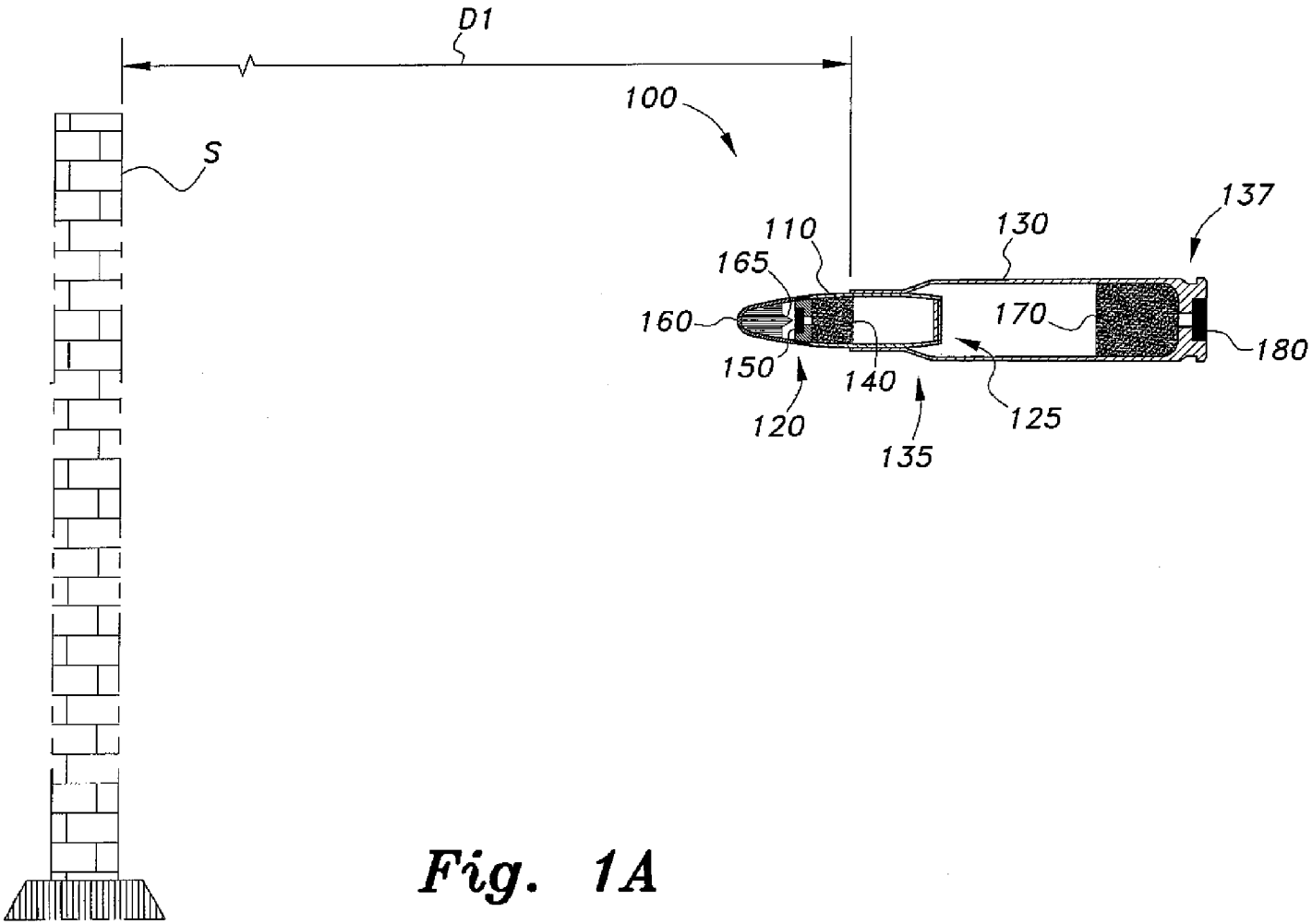
FIG. 1A is an environmental, side view of a bullet for striking obstructed targets according to the present invention.
Figure 1B:
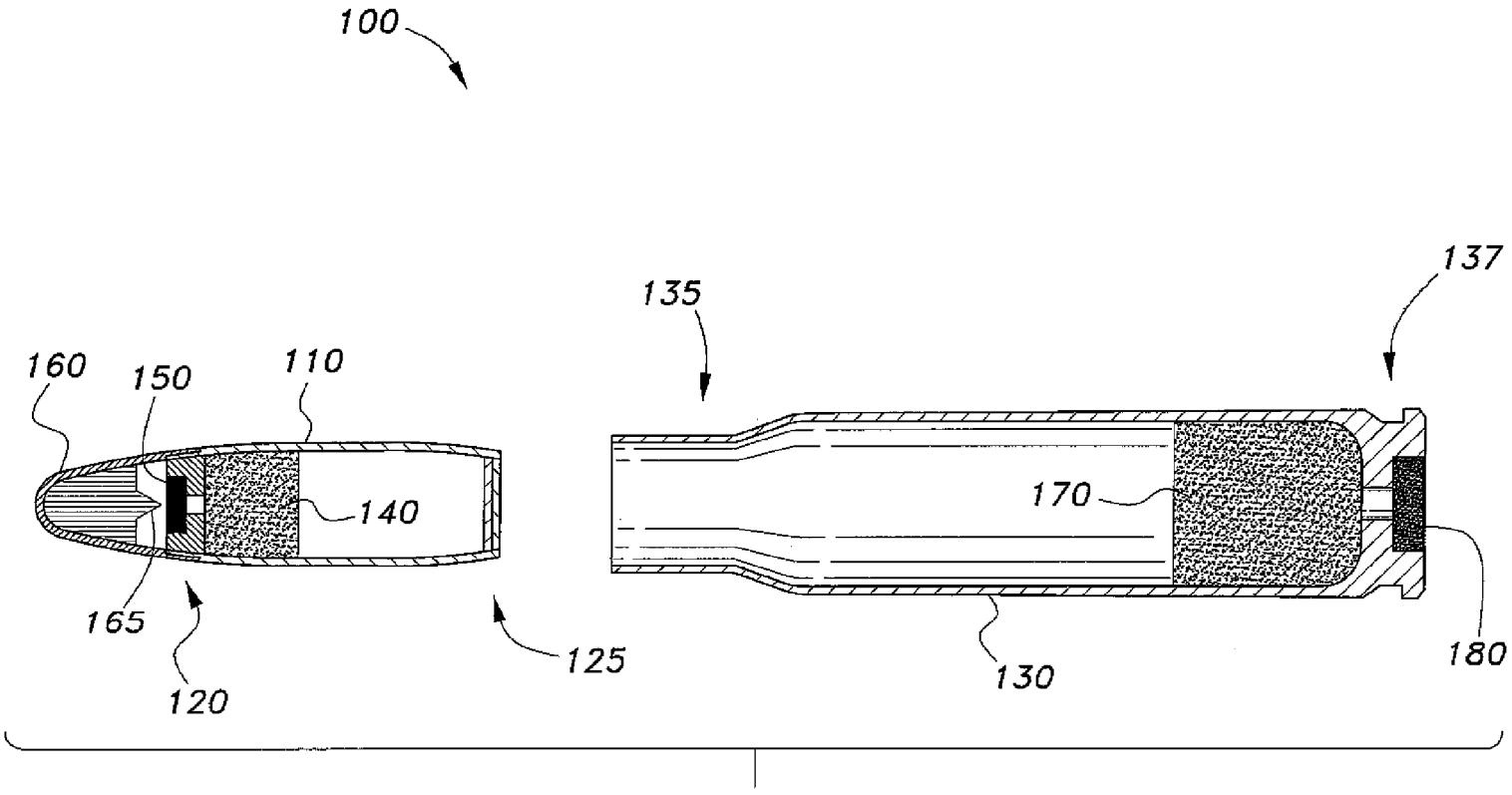
FIG. 1B is an environmental, side view of a detachable bullet casing of a bullet detached from a main bullet casing of a bullet according to the present invention.

Referring to FIGS. 1A and 1B, a bullet 100 for striking obstructed targets is generally illustrated. The bullet 100 includes a main bullet casing 130 having a primary front portion 135 and a primary rear portion 137 and a detachable bullet casing 110 having a secondary front portion 120 and a secondary rear portion 125. The secondary rear portion 125 of the detachable bullet casing 110 is positioned in communicating relation with the primary front portion 135 of the main bullet casing 130, as illustrated in FIG. 1A. The main bullet casing 130 can include a primary propellant 170 and a primary firing means 180, such as a primer, configured to ignite the primary propellant 170. Primary firing means 180 is positioned in the primary rear portion 137 of the main bullet casing 130. The detachable bullet casing 110 can include a secondary propellant 140 and a secondary firing means 150, such as a primer, configured to ignite the secondary propellant 140, the secondary firing means 150 being positioned in the secondary front portion 120 of the detachable bullet casing 110. The bullet 100 also includes a bullet head 160 positioned on the secondary front portion 120 of the detachable bullet casing 110. The bullet head 160 has a triggering means 165, such as a firing pin, positioned in communicating relation to the secondary firing means 150 configured to ignite the secondary firing means 150 (e.g. act in a similar fashion to a weapon's firing pin).

The main bullet casing 130 and the detachable bullet casing 110 can have any suitable design, such as a centerfire cartridge design or a rimfire cartridge design, and can be configured to be used with any type of light weapon, such as fully automatic weapons, semi-automatic weapons, as well as guns and rifles. Further, the main bullet casing 130 and the detachable bullet casing 110 can be made from any type of suitable material, such as brass, steel, or aluminum.

The bullet head 160 can have any suitable shape, such as a conical shape or a substantially conical shape with a tip, such as a pointed tip. The bullet head 160 and can have any type of design and/or caliber suitable for the environment in which the bullet 100 is being used. The bullet head 160 and the triggering means 165 can be formed from any suitable type of material, such as lead, an alloy composite of lead and tin, or jacketed lead. The bullet head 160 can include hard cast bullets, practice bullets, incendiary bullets, exploding bullets, tracer bullets, as well as armor piercing bullets.

The primary propellant 170 and the secondary propellant 140 can include any suitable type of propellant, such as gunpowder and/or cordite. It is to be noted that the primary propellant 170 and the secondary propellant 140 do not have to be the same type of propellant. For example, the primary propellant 170 can be gunpowder and the secondary propellant 140 can be cordite or vice versa, depending on the design requirements of the bullet 100. Further, the amount or quantity of primary propellant 170 contained in the main bullet casing 130 can be different from the amount or quantity of secondary propellant 140 in the detachable bullet casing 110. For example, the detachable bullet casing 110 can include a given amount of secondary propellant 140 and the main bullet casing 130 can include an amount that is greater than the amount of primary propellant 170, so as to counterbalance the detachable bullet casing 110.

Referring to FIGS. 1A, 2A-3C, by way of operation, once a person detects an obstructed target T, such as a target hiding behind oil drums D, from a distance D1, the person can aim a weapon (not shown), such as a gun or a rife, having the bullet 100 at a stationary object S (e.g., wall) positioned behind the obstructed target T and depress the trigger (not shown) of the weapon so as to discharge the detachable bullet casing 110.

Figure 2A:
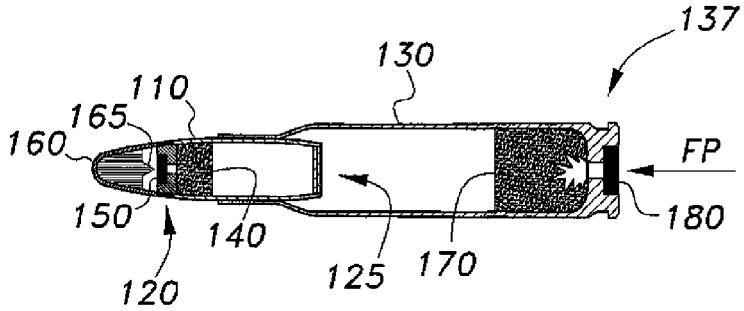
FIG. 2A illustrates the ignition of a primary firing means according to the present invention.
Figure 2B:
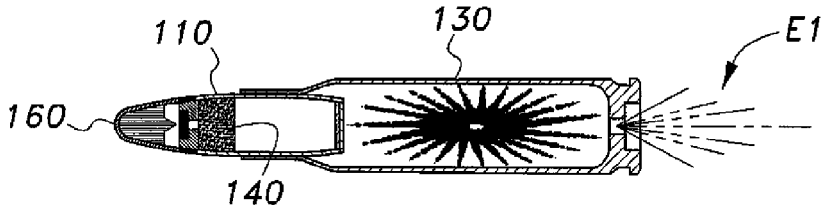
FIG. 2B illustrates the ignition of a primary propellant according to the present invention.
Figure 2C:
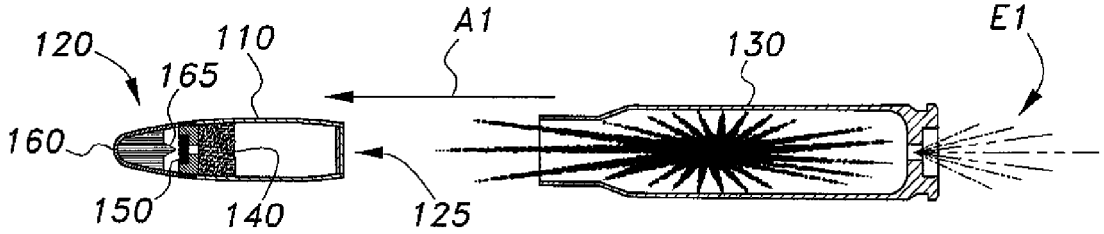
FIG. 2C illustrates a detachable bullet casing being propelled away from a main bullet casing by the explosion of a primary propellant according to the present invention.

Upon depressing the trigger of the weapon, the weapon's firing pin, as illustrated by the arrow FP in FIG. 2A, can strike the primary firing means 180 positioned in the primary rear portion 137 of the main bullet casing 130. The primary firing means 180 can then deflagrate, e.g. rapidly burn, as illustrated in FIG. 2A, and, in turn, produce a burning gas, which can ignite the primary propellant 170 contained within the main bullet casing 130, as illustrated in FIG. 2B. It is to be noted that some of the gas can form a primary exhaust E1 that can escape from the primary rear portion 137 of the main bullet casing 130, as illustrated in FIG. 2B. The gases, such as the gases produced from the ignition of the primary propellant 170 that do not escape from the primary rear portion 130 of the main bullet casing 130, can generate sufficient pressure so as to push against the secondary rear portion 125 of the detachable bullet casing 110. In response to this pressure, the detachable bullet casing 110 can be propelled in a forward direction, away from the main bullet casing 130, as illustrated by arrow A1 in FIG. 2C.

Figure 2D:
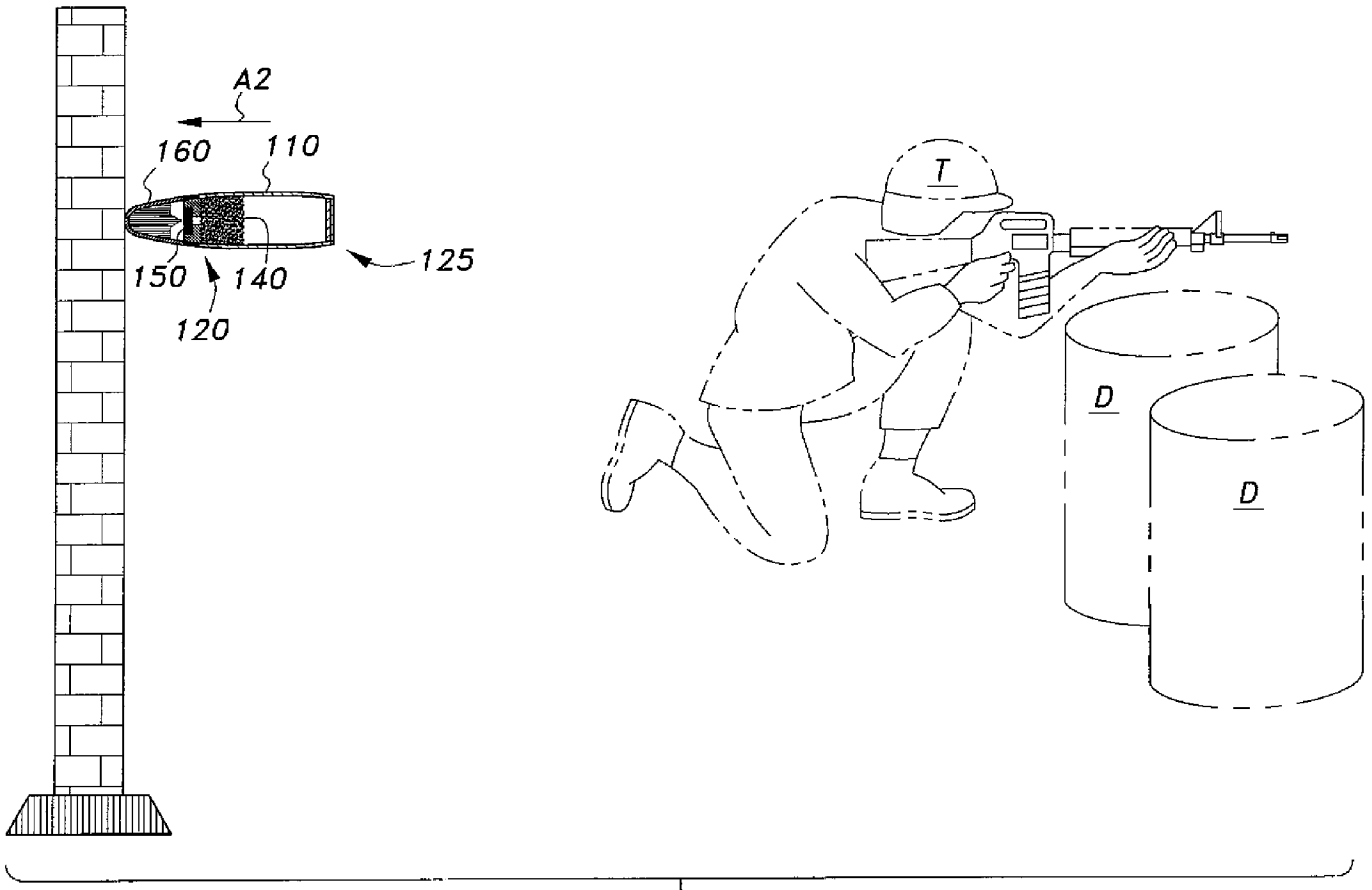
FIG. 2D illustrates a detachable bullet casing passing an obstructed target according to the present invention.
Figure 3A:
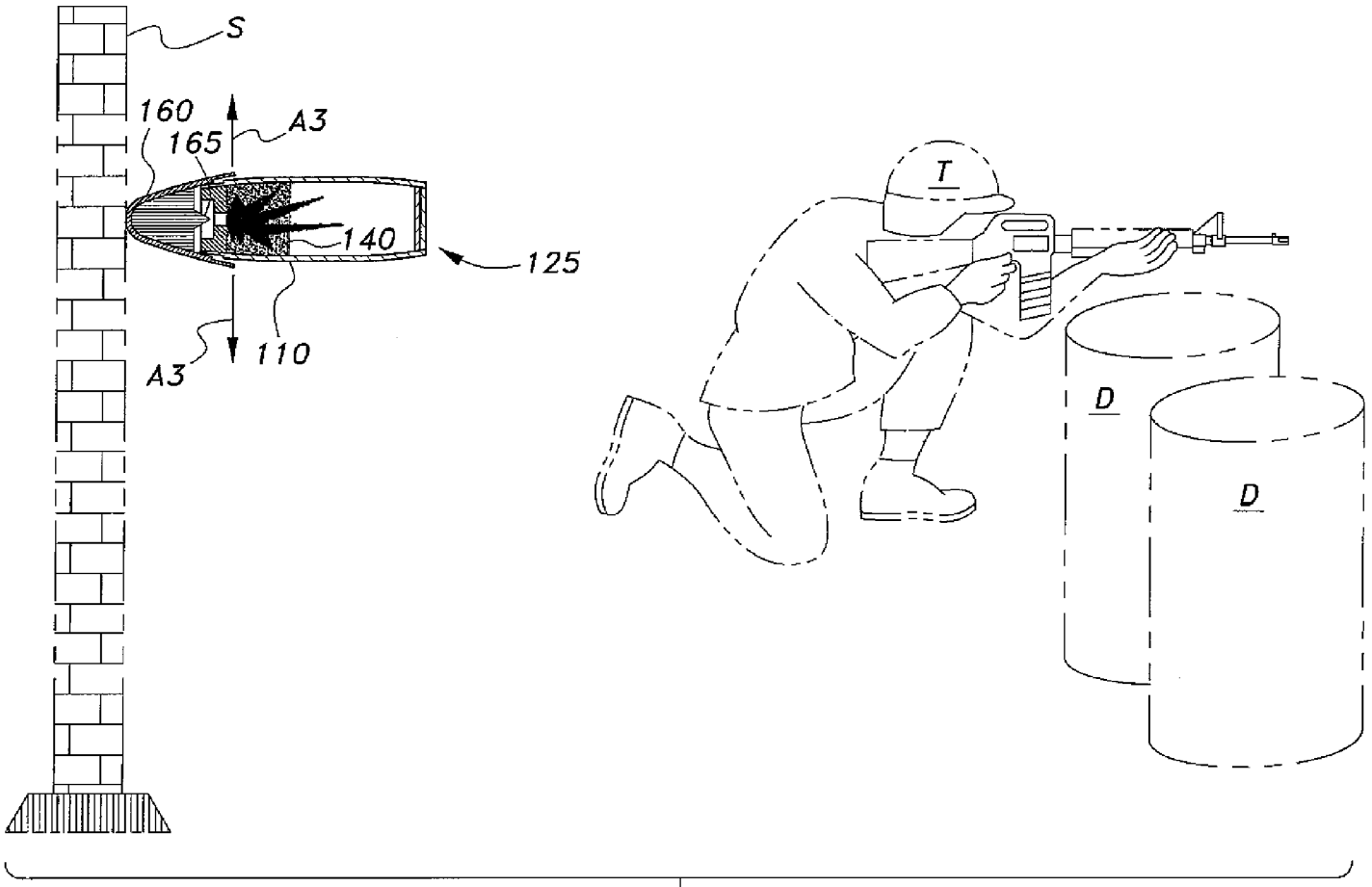
FIG. 3A illustrates a detachable bullet casing striking a stationary object and igniting a secondary firing means according to the present invention.

After the detachable bullet casing 110 is discharged from the main bullet casing 130, the detachable bullet casing 110 can travel past the obstructed target T until the bullet head 160 positioned on the secondary front portion 120 of the detachable bullet casing 110 strikes the stationary object S, as illustrated by arrow A2 in FIG. 2D. Upon striking the stationary object S the triggering means 165 of the bullet head 160 can act as a firing pin so as to ignite the secondary firing means 150, as illustrated in FIG. 3A. The ignition of the secondary firing means 150 can produce sufficient burning gas so as to push the outer portion of the bullet head 160 in an outward direction, as illustrated by arrows A3 in FIG. 3A, so as to release the detachable bullet casing 110, as well as ignite the secondary propellant 140 contained in the detachable bullet easing 110, as illustrated in FIG. 3B.

Figure 3B:
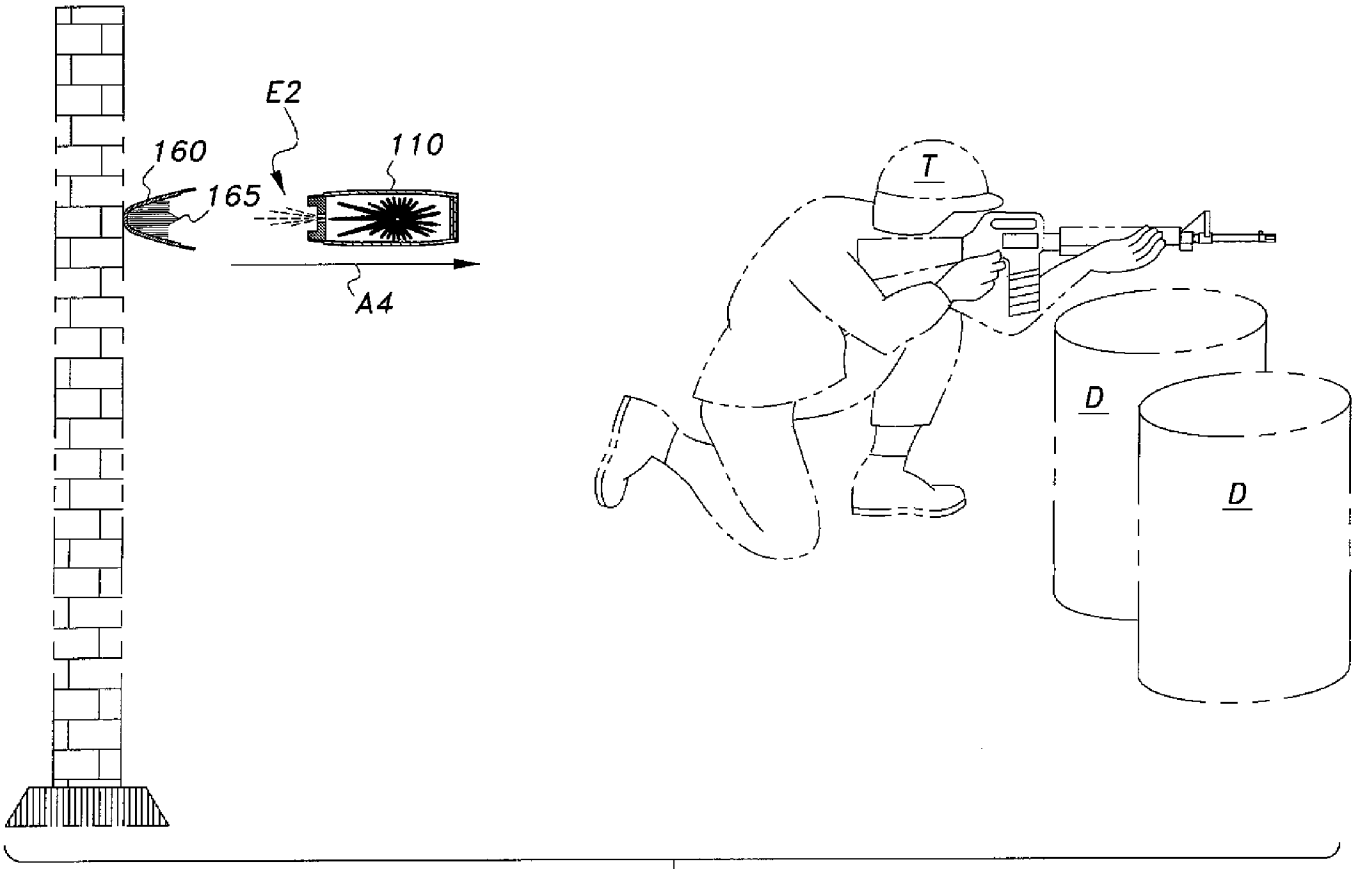
FIG. 3B illustrates a detachable bullet casing being propelled away from a bullet head by the explosion of a secondary propellant according to the present invention.

The propellant gases, such as the gases produced from the ignition of the secondary propellant 140, can generate pressure that push against the bullet head 160 and propel the detachable bullet casing 110 backwards, away from the bullet head 160 and toward the obstructed target T, as illustrated by arrow A4 in FIG. 3B, so as to strike the target T hiding behind oil drums D, as illustrated by arrow A5 in FIG. 3C. It is to be noted that ignition of the secondary propellant 140 can create a secondary exhaust E2 so as to either propel the detachable bullet casing 110 further in a certain direction or to increase the impact of the detachable bullet casing 110 against the target T.

It is to be understood that the present invention is not limited to the embodiments described above, but encompasses any and all embodiments within the scope of the following claims.

I claim:

1. An ammunition cartridge for secondary firings at obstructed targets, the ammunition cartridge comprising:

a first casing including a primary front portion and an opposing primary rear portion;

a primary propellant disposed in the first casing;

a primary firing means positioned in the primary rear portion of the first casing, the primary firing means designed and configured to ignite the primary propellant;

a second casing having a secondary front portion and an opposing secondary rear portion;

wherein the secondary rear portion of the second casing positioned in communicating relation to the primary front portion of the first casing;

a secondary propellant disposed within the second casing;

a secondary firing means positioned in the secondary front portion of the second casing, the secondary firing means designed and configured to ignite the secondary propellant; and a bullet head positioned in the secondary front portion of the second casing; and a triggering means disposed in the bullet head and positioned in communicating relation to the secondary firing means;

wherein the triggering means being designed and configured to ignite the secondary firing means;

whereby, upon impact of the bullet head with a substantially hard surface, the triggering means ignites the secondary firing means, causing the secondary rear portion of the second casing to be launched in an opposite direction of the bullet head, and capable of impacting the obstructed target.

2. The ammunition cartridge according to claim 1, wherein the primary firing means includes a primer; and the secondary firing means includes another primer.

3. The ammunition cartridge according to claim 2, wherein the primary propellant is selected from the group consisting essentially of cordite and gunpowder.

4. The ammunition cartridge according to claim 2, wherein the secondary propellant is selected from the group consisting essentially of cordite and gunpowder.

5. The ammunition cartridge according to claim 1, wherein the amount of primary propellant is greater than the amount of secondary propellant.

6. The ammunition cartridge according to claim 1, wherein the bullet head is a selected from a group consisting of hard cast bullets, practice bullets, incendiary bullets, exploding bullets, tracer bullets, and armor piercing bullets.

7. A method for striking obstructed targets by firing an ammunition cartridge, the method comprising:

providing the ammunition cartridge, the ammunition cartridge having:

a first casing including a primary front portion and an opposing primary rear portion;

a primary propellant disposed in the first casing;

a primary firing mechanism positioned in the primary rear portion of the first casing, the primary firing mechanism designed and configured to ignite the primary propellant;

a second casing having a secondary front portion and an opposing secondary rear portion;

the secondary rear portion of the second casing positioned in relation to the primary front portion of the first casing;

a secondary propellant disposed within the second casing;

a secondary firing mechanism positioned in the secondary front portion of the second casing, the secondary firing mechanism designed and configured to ignite the secondary propellant; and a bullet head positioned in the secondary front portion of the second casing; and a triggering mechanism disposed in the bullet head and positioned in relation to the secondary firing mechanism, the triggering mechanism for selectively igniting the secondary firing mechanism;

launching the second casing and bullet head from the first casing;

impacting the bullet head upon a substantially hard surface;

igniting the secondary firing mechanism with the triggering mechanism;

launching the secondary rear portion of the second casing in a direction opposite the bullet head; and impacting the obstructed target with the second casing.

* * * * *